US007066466B1

(12) United States Patent
Stavinsky et al.

(10) Patent No.: US 7,066,466 B1
(45) Date of Patent: Jun. 27, 2006

(54) BLACKJACK STYLE GAME METHOD WITH SUIT-BASED SIDE WAGER

(76) Inventors: Emil Stavinsky, 2333 Industrial Rd., Las Vegas, NV (US) 89102; Michael Wichinsky, 2577 S. Highland Dr., Las Vegas, NV (US) 89109

( * ) Notice: Subject to any disclaimer, the term of this patent is extended or adjusted under 35 U.S.C. 154(b) by 0 days.

(21) Appl. No.: 10/881,077

(22) Filed: Jun. 29, 2004

(51) Int. Cl.
*A63F 1/00* (2006.01)

(52) U.S. Cl. ..... 273/292; 273/274; 273/309

(58) Field of Classification Search ..... 273/292, 273/274, 309
See application file for complete search history.

(56) References Cited

U.S. PATENT DOCUMENTS 5,423,551 A * 6/1995 Stavinsky ..... 273/306
5,549,300 A * 8/1996 Sardarian ..... 273/292
5,944,314 A * 8/1999 Stavinsky ..... 273/292
5,979,897 A * 11/1999 Grossman ..... 273/292
6,062,564 A * 5/2000 Terminel ..... 273/292
6,095,525 A * 8/2000 Terminel ..... 273/274
6,206,375 B1 * 3/2001 Wichinsky ..... 273/292
6,585,588 B1 * 7/2003 Hartl ..... 463/16
6,692,003 B1 * 2/2004 Potter et al. ..... 273/274
6,808,173 B1 * 10/2004 Snow ..... 273/292

* cited by examiner

*Primary Examiner*—Eugene Kim
*Assistant Examiner*—Dolores Collins
(74) *Attorney, Agent, or Firm*—Robert Ryan Morishita; Morishita Law Firm, LLC

(57) ABSTRACT

A method for playing a modified Blackjack game is set forth using decks containing an extra 11 and/or 12 value card(s). Prior to play each player makes a Blackjack game wager and a suit wager. After one or more cards are dealt to each player a suit designating card is dealt and revealed and if one or both of the player's first two cards are of the same suit as the suit designating card, the player wins the suit wager. Thereafter, each player hand and the dealer hand are completed according to the rules of Blackjack (slightly modified due to the inclusion of the additional 11 and/or 12 value cards) and the Blackjack wagers are resolved.

16 Claims, No Drawings

BLACKJACK STYLE GAME METHOD WITH SUIT-BASED SIDE WAGER

FIELD OF THE INVENTION

The present invention relates to Blackjack style card games. More particularly it relates to such a game using a standard deck of playing cards with additional 11 and or 11 or 12 value cards and where the player may make a side wager directed to suited cards in the player and dealer hands.

BACKGROUND OF THE INVENTION

Standard or conventional Blackjack is known in the prior art of casino card games. In conventional Blackjack, sometimes referred to "21", played throughout casinos in the United States, each player makes a wager and the dealer deals two cards to each player to define an initial player holding and two cards to himself defining a dealer's initial holding. The cards may be dealt from a single, standard deck of 52 playing cards (Ace–King in the suits of Clubs, Diamonds, Hearts and Spades), or from multiple decks such as by being dealt from a "shoe" configured to initially hold up to, for example, six standard decks of 52 cards each. The cards to the player(s) may be dealt face up or face down. For the dealer, in the traditional game, one of the dealer's cards of his initial holding is turned face up, typically the first card dealt to the dealer's hand. Each player, in turn, has the opportunity to complete his or her hand in a manner well known in the art. The object of the game is for the player to assemble a final hand which (1) has a higher count value than the dealer's final hand without the value exceeding a predetermined target value which, in traditional Blackjack, is 21. In this regard each player may exercise the following options:

1. To stand on the value of the initial holding making the initial holding the player's final holding;
2. Being dealt additional cards (taking "hits") to try to achieve or come close to the target value of 21;
3. To "double down" (double his or her initial wager) which may be made, according to the casino's rules, only available when the count of the initial player hand is "10" or "11";
4. To "split" card pairs, e.g. a pair of 8s of the initial holding into two hands and play each hand separately;
5. To "surrender" his or her hand by giving up half his or her wager (this to may not be permitted by some casino rules or only permitted when the dealer has a certain value of the exposed card; and/or
6. Take insurance by wagering an amount equal to the player's game wager and if the dealer has a "Natural" (a count in his initial hand of "21"), the player wins 2:1 and therefore, basically, does not win or lose.

As stated above the rules of traditional Blackjack regarding the player's actions are well known in the art.

Once the players have completed their hands, the dealer does as well by taking hits or standing according to well known rules. A variation included in those rules is that the dealer may be required to stand on a "soft 17" (i.e. a hand count of 17 including an Ace which counts as a "1" or an "11"). Other rules require the dealer to hit a soft "17".

If the player exceeds the target value of "21" the player loses his or her wager regardless if the dealer also ultimately exceeds the target value of 21. If the player's hand does not exceed the target value and (1) his hand has a value exceeding the dealer or (2) the dealer exceeds the target value, the player wins and is paid 1:1 on his game wager. If the dealer does not exceed the target value and his hand has a greater value than the player's final hand, the player loses his or her wager. If player's and dealer's final hand values are the same, it is a tie (or "push") and the player neither wins nor loses.

In traditional Blackjack the hand values are based upon a card valuing schedule as follows:

| Card | Value |
|---|---|
| Ace | 1 or 11 |
| K, Q, J, 10 | 10 |
| 2–9 | card value |

It has also been known to program a computer for a player to play the game against the computer. Hand held, electronic, Blackjack game devices have also been known.

Regarding the constituency of the deck of cards, it has been known to add additional cards to a standard deck and modify the play rules. For example in Wichinsky, U.S. Pat. No. 6,206,375 issued Mar. 27, 2001, the disclosure of which is hereby incorporated by reference, there is disclosed a Blackjack game where the deck used for play consists of the standard 52 cards with additional 11 and 12 value cards of each suit for a full compliment of 60 cards and where splits are either completely disallowed or only allowed to avoid an automatic loss. The addition of the 11 and 12 value cards provides the player with an opportunity to obtain a two card "21" with an Ace or 10 value card and thus, according to the referenced provides, for side wager options.

Players are continually seeking more entertaining card games to play. From a casino standpoint, such enterprises are seeking new games which (1) will draw players because of exciting, challenging or rewarding game features and (2) provide the casino with additional revenue sources from the game such as by providing side wagers.

There is a need for an improved Blackjack-style game which has features including (1) being different and more exciting than standard Blackjack, (2) which refers to the known rules of Blackjack and thereby is familiar to players and easy to understand and which provides the players and the casino with additional and novel wagering propositions which are determined during the normal course of play.

SUMMARY OF THE INVENTION

There is, therefore, set forth according to the present invention a method for playing a modified Blackjack game using at least one modified deck of cards including the 52 cards of a standard deck with additional cards represented by at least one of (i) 11 value cards for each suit and/or (ii) 12 value cards for each suit. Thus, each modified deck may consist of 56 or 60 cards.

To play the game each player makes a base game wager and suit wager prior to the dealing of cards. Play may be at a Blackjack-type table having a dealer position and up to seven player positions. The game may also be played in an electronic form by one or more players where cards are selected and displayed at one or more displays. As one example, a single player may play against the machine according to the game method of the present invention in a manner similar to known video Blackjack games.

After each player has made his or her wagers, the amounts of which may be dictated by house rules, one or more cards of an initial holding are selected and displayed for each player and for a dealer position, e.g. dealt from the modified deck of playing cards.

The method includes comparing the suits of at least one of the cards of the player initial holding to the suit of a suit designating card which may be one of the cards of the dealer's hand card or a separately dealt card and if there is a predetermined suit-related relationship, such as the first card dealt to the player being of the same suit as the suit designating card, issuing an award to the player based upon the suit wager and if the predetermined relationship does not exist the player losing his or her suit wager. In one embodiment, the suit wager is resolved after a single card is dealt to each player and dealer. In another embodiment, a separate suit designating card is selected and displayed apart from the dealer's hand to define the suit against which the player's card is compared. In another embodiment, the dealer and player hands are each initially dealt two cards, as in standard Blackjack, a separate suit card is dealt and displayed and one, each or both of player's cards of the initial holding are compared for the predetermined suit relationship. For example, for the player to win the suit wager, the first card dealt to the player or both cards must match the suit of the suit card for the player to receive an award based upon the suit wager.

In yet another optional embodiment, the suit wagers are resolved based on the base game. In one such optional embodiment, suit wagers may only be eligible to be paid under certain circumstances in the base game. For example, if a player has a normal Blackjack win, suit wagers do not qualify to be paid. In another such optional embodiment, a player who wins the suit bet, such as by having two cards of the same suit showing in any position that match the suit card, but loses the base Blackjack game, receives the player's base wager back.

In another embodiment, the suit wager is determined after a single card is dealt to each player and the suit card is exposed. If the player's card is of the same suit, the player is entitled to an award. The player may opt to take the award or may "press" his wager. If the player presses his or her wager and the second card dealt is of the same suit as the first player card and a suit card, the player is entitled to an enhanced award. If the second card is of a different suit, the player would lose his or her suit wager.

To determine the outcome of the base game wager, each player and the dealer complete their hands according to the rules of the modified Blackjack game such as described in Wichinsky, U.S. Pat. No. 6,206,375. After each player and the dealer have completed their hands, the base game wager is resolved according to the rules of the modified Blackjack game.

Other variations may be that the predetermined relationship between the designated player's card(s) and the suit card is that for the player to receive an award the cards must be of the same color suit or must be of different suits. Different award schedules may be adopted to vary the award such as, for example, the player wins even money if the designated player card is of the same suit and the suit wager is a tie ("push") if the suits are not the same but are of the same color.

Other awards and pay schedules may be adopted where all or a predetermined minimum number of cards of the player's hand (or the player's hand in combination with the dealer's hand) are of the same suit as the suit card.

The method of the present invention adds a side wager component to a modified Blackjack game providing an exciting and challenging game method to players.

DESCRIPTION

To play the game of the present invention, the method includes providing for play one or more modified decks of playing cards. Each deck for the start of play includes the 52 cards of a standard deck of cards, deuce through ace of the four suits of Clubs, Diamonds, Hearts and Spades plus additional 11 and/or 12 value cards for each suit. Thus each deck of cards may be configured as follows:

| | |
|---|---|
| Modified Deck 1 | Deuce–Ace + 11 value card × 4 suits = 56 cards |
| Modified Deck 2 | Deuce–Ace + 12 value cards × 4 suits = 56 cards |
| Modified Deck 3 | Deuce–Ace + 11 and 12 value cards × 4 suits = 60 cards |

To play the game, whichever modified deck version is chosen, all decks are of the same constituency, i.e. deck variations are not mixed.

For play, single or multiple modified decks may be used, for example up to six decks, and the cards may be dealt from a shoe.

Where the game is played in a live format, the player(s) and dealer are positioned at a table such as a standard Blackjack table having a dealer position as well as up to seven player positions. Where the game is played in an electronic format, a single player may be competing against hands selected and displayed by a computer, as is known in the art. For purposes of the following description, the live table game version shall be used. It should be understood that the method of the present invention could be programmed into a gaming machine, PDA, hand held novelty game, computer game or could be played on the Internet.

To begin play, each player makes a base game wager and an optional suit wager. The amount of the wagers may be dictated by house rules. Further the relation between the amounts of the base and suit wagers may be controlled as well such as by restricting the suit wager to be equal to or a multiple of the base wager. For purposes of discussion it shall be assumed that each player has opted to make the suit wager.

Version 1

After each player has made his or her required wagers, the dealer deals a single card to each player hand and to a dealer hand. If the initial card dealt to the player matches the suit the of the card dealt to the dealer hand, the player is entitled to an award based upon the player's suit wager. If the suits do not match the player loses the player's suit wager. After the suit wagers have been resolved for each player having made the suit wager, the dealer deals a second card to each player hand and the dealer hand to define for each an initial two card holding. Each player, in turn, completes his or her hand according o the rules of Blackjack (as modified by Wichinsky as recited above, to account for the 11 and/or 12 value cards. For example, if a player is dealt two 11 value cards, two 12 value cards or one of each for a total exceeding "21" (a bust hand), the player may split his or her hands to avoid an automatic loss. Further a "Blackjack" is defined as an Ace with a 10 value card whereas all other hands having a value of "21", e.g. an 11 value card and a 10 value card, are simply an hand total of 21.

After each player has completed the player's hand(s), the dealer completes his hand to a final hand value. Thereafter each player's hand is compared in order as in standard Blackjack and the player's base game wager is resolved.

Version 2

According to this version of the method of the present invention, if the player has a first card matching suit as described in Version 1 above, the player may opt to take the winnings or "press" the winnings and wager that the second card dealt to the player will be of the same suit as well. In the event the player opts to "press" the winnings and the second card is of a different suit, the player loses his or her wager and any award he/she had won by virtue of the first card matching. If the second card is of the same suit, the player is entitled to an additional award. The additional award may be a multiple of the first award to provide an incentive for the player to "press" his or her award. After the suit wagers are resolved, the base Blackjack game is completed as described above.

Version 3

According to this embodiment, the dealer deals two cards to each player and the dealer before resolving the suit wager. After the two cards are dealt, the dealer compares one or both of the player's cards for each player hand to a suit designating card defined by one of (a) the exposed card of the dealer hand or (b) a separately dealt and exposed card. According to one embodiment, the player wins his or her wager if any card in the player hand matches the suit of the suit designating card. In another embodiment the player wins his or her suit wager only when both of the player's cards match the suit of the suit designating card.

It is noted that resolution of the suit wager in this version could take place before or after resolution of the base Blackjack wager. In a further optional embodiment, the outcome of the base Blackjack game may dictate how the suit wagers are handled. For example, in one optional embodiment, suit wagers may be disqualified from payment if the player has a normal Blackjack win. This could include any form of win or could be limited to a particular win, such as a natural.

In another optional embodiment, the resolution of the suit wager may affect the resolution of the base wager. For example, in one optional embodiment, if the player loses in his normal Blackjack hand but wins the suit wager, the player's original bet may be returned. As discussed above, winning the suit wager could include the player's hand containing a predetermined number of cards, in any position, matching the suit card.

While we have described certain embodiments of the present invention it should be understood that it is subject to modifications without departing from the spirit and scope of the appended claims.

We claim:

1. A method for playing a modified Blackjack game between a dealer and at least one player using a deck of at least 56 cards including the standard cards of Ace through King and one of 11 or 12 value cards for each suit, the method comprising:

(i) the player making a base game wager and suit wager prior to the dealing of cards;

(ii) dealer dealing an initial holding of at least one card to each player and exposing a suit designating card;

(iii) resolving said suit wager by comparing the suits of at least one of the cards of the player initial holding to the suit of the suit designating card and if there is a predetermined suit-related relationship issuing an award to the player based upon the suit wager and if the predetermined relationship does not exist the player losing the suit wager;

(iv) each player and dealer completing their hands according to the rules of the modified Blackjack game; and (v) resolving each player's base game wager by comparing each completed player hand to the completed dealer hand according to the rules of said modified Blackjack game, wherein said suit wager is resolved after said step of resolving said base game wager and if said player wins said base game wager according to the rules of said modified Blackjack game, the resolution of said suit wager includes disqualifying said player from receiving said award without regard to whether there is a predetermined suit-related relationship between the player's cards and the suit designating card.

2. The method of claim 1 further comprising designating the predetermined relationship to be at least one of the cards of the player's initial holding being of the same suit as the suit designating card.

3. The method of claim 1 further comprising designating one of the dealer's cards as the suit designating cards.

4. The method of claim 3 further comprising dealing one card to each player hand, resolving the suit wager according to step (iii), the player opting to accept the award if the first dealt card to the player is of the same suit as the suit designating card or pressing the suit wager, dealing a second card to the player and if the second card is of the same suit as the suit designating card and first player card, issuing a greater award to the player otherwise the player losing the suit wager.

5. A method for playing a modified Blackjack game between a dealer and at least one player using a deck of at least 56 cards including the standard cards of Ace through King and one of 11 or 12 value cards for each suit, the method comprising:

(i) the player making a base game wager and suit wager prior to the dealing of cards;

(ii) dealer dealing an initial holding of at least one card to each player and exposing a suit designating card;

(iii) resolving said suit wager by comparing the suits of at least one of the cards of the player initial holding to the suit of the suit designating card and if there is a predetermined suit-related relationship issuing an award to the player based upon the suit wager and if the predetermined relationship does not exist the player losing the suit wager;

(iv) each player and dealer completing their hands according to the rules of the modified Blackjack game; and (v) resolving each player's base game wager by comparing each completed player hand to the completed dealer hand according to the rules of said modified Blackjack game, wherein said suit wager is resolved after said step of resolving said base game wager and if said player loses said base game wager according to the rules of said modified Blackjack game, the resolution of said suit wager including returning the player base game wager if there is a predetermined suit-related relationship between the player's cards and the suit designating card.

6. The method of claim 5 comprising designating the predetermined relationship to be at least one of the cards of the player's initial holding being of the same suit as the suit designating card.

7. The method of claim 5 comprising designating one of the dealer's cards as the suit designating cards.

8. The method of claim 7 comprising dealing one card to each player hand, resolving the suit wager according to step (iii), the player opting to accept the award if the first dealt card to the player is of the same suit as the suit designating card or pressing the suit wager, dealing a second card to the player and if the second card is of the same suit as the suit designating card and first player card, issuing a greater award to the player otherwise the player losing the suit wager.

9. A method for playing a modified Blackjack game between a dealer and at least one player using a deck of at least 56 cards including the standard cards of Ace through King and one of 11 or 12 value cards for each suit, the method comprising:

(i) the player making a base game wager prior to the dealing of cards;

(ii) dealer dealing an initial holding of at least one card to each player and exposing a suit designating card;

(iii) each player and dealer completing their hands according to the rules of the modified Blackjack game;

(iv) resolving each player's base game wager by comparing each completed player hand to the completed dealer hand according to the rules of said modified Blackjack game; and (v) after resolving each player's base game wager, comparing the suits of at least one of the cards of the player initial holding to the suit of the suit designating card and if there is a predetermined suit-related relationship issuing an award to the player, wherein if said player wins said base game wager according to the rules of said modified Blackjack game, said player is disqualified from receiving said award without regard to whether there is a predetermined suit-related relationship between the player's cards and the suit designating card.

10. The method of claim 9 further comprising in step (v), if said player loses said base game wager according to the rules of said modified Blackjack game, said player's base game wager is returned to said player if there is a predetermined suit-related relationship between the player's cards and the suit designating card.

11. The method of claim 9 further comprising designating the predetermined relationship to be at least one of the cards of the player's initial holding being of the same suit as the suit designating card.

12. The method of claim 9 further comprising designating one of the dealer's cards as the suit designating cards.

13. A method for playing a modified Blackjack game between a dealer and at least one player using a deck of at least 56 cards including the standard cards of Ace through King and one of 11 or 12 value cards for each suit, the method comprising:

(i) the player making a base game wager prior to the dealing of cards;

(ii) dealer dealing an initial holding of at least one card to each player and exposing a suit designating card;

(iii) each player and dealer completing their hands according to the rules of the modified Blackjack game;

(iv) resolving each player's base game wager by comparing each completed player hand to the completed dealer hand according to the rules of said modified Blackjack game; and (v) after resolving each player's base game wager, comparing the suits of at least one of the cards of the player initial holding to the suit of the suit designating card and if there is a predetermined suit-related relationship issuing an award to the player, wherein if said player loses said base game wager according to the rules of said modified Blackjack game, said player's base game wager is returned to said player if there is a predetermined suit-related relationship between the player's cards and the suit designating card.

14. The method of claim 13 further comprising in step (v), if said player wins said base game wager according to the rules of said modified Blackjack game, said player is disqualified from receiving said award without regard to whether there is a predetermined suit-related relationship between the player's cards and the suit designating card.

15. The method of claim 13 further comprising designating the predetermined relationship to be at least one of the cards of the player's initial holding being of the same suit as the suit designating card.

16. The method of claim 13 further comprising designating one of the dealer's cards as the suit designating cards.

* * * * *